US006283830B1

(12) United States Patent
Kuo

(10) Patent No.: US 6,283,830 B1
(45) Date of Patent: Sep. 4, 2001

(54) GRINDING CONTROL UNIT OF A TOOL BIT GRINDER

(76) Inventor: Chun-Lin Kuo, No. 33-17, Lane 320 Sec1., Sha-Tien Rd., Ta-Tu Hsiang (TW)

( * ) Notice: Subject to any disclaimer, the term of this patent is extended or adjusted under 35 U.S.C. 154(b) by 0 days.

(21) Appl. No.: 09/617,926

(22) Filed: Jul. 17, 2000

(51) Int. Cl.[7] ..... B24B 49/00

(52) U.S. Cl. ..... 451/11; 451/48; 451/177; 451/366; 451/375; 451/377

(58) Field of Search ..... 451/11, 48, 177, 451/366, 375, 379

(56) References Cited

U.S. PATENT DOCUMENTS 4,411,105 * 10/1983 Raiha ..... 451/276
4,683,626 * 8/1987 Steiner ..... 29/40
5,681,209 * 10/1997 Naumann et al. ..... 451/51
5,702,294 * 12/1997 Baltazar et al. ..... 451/541

* cited by examiner

*Primary Examiner*—Joseph J. Hail, III
*Assistant Examiner*—Shantese McDonald
(74) *Attorney, Agent, or Firm*—Charles E. Baxley

(57) ABSTRACT

A grinding control unit installed in a tool bit grinder and adapted to control the feeding of a bit relative to a grinding wheel of a grinding unit of the tool bit grinder, the grinding control unit including a U-shaped support, a chuck adapted to hold the bit to be ground, a feeder adapted to control feeding stroke of the bit a swinging control mechanism adapted to control swinging stroke of the bit when feeding the bit, enabling two lips of the tip of the bit to be ground, a horizontal displacement control mechanism adapted to control the depth of bit feeding stroke, enabling the spur of the bit to be well ground.

6 Claims, 10 Drawing Sheets

GRINDING CONTROL UNIT OF A TOOL BIT GRINDER

BACKGROUND OF THE INVENTION

The present invention relates to a tool bit grinder, and more specifically to a grinding control unit installed in a tool bit grinder and adapted to control the feeding of the bit to be ground relative to the grinding wheel of the grinding unit of the tool bit grinder.

A variety of manual drills, hand drills and power drills have been disclosed, and have appeared on the market. These drills commonly use a bit to cut the workpiece. Because the cutting edge of a bit wears quickly with use, it must be regularly ground with a grinder. However, because the tip of a bit has particularly curved faces, grinding a bit requires skill. An experienced master still need much time to complete the grinding of a bit. There are known various automatic tool bit grinders available on the market. However, these automatic tool bit grinders are commonly expensive, not economic to every user.

SUMMARY OF THE INVENTION

The present invention has been accomplished under the circumstances in view. It is one object of the present invention to provide a grinding control unit for a tool bit grinder, which can easily be operated to feed the bit and simultaneously to turn the bit to the desired grinding angle. It is another object of the present invention to provide a grinding control unit for a tool bit grinder, which can be easily operated to control the feeding depth of the bit when grinding the bit. It is still another object of the present invention to provide a grinding control unit for a tool bit grinder, which is simple, compact, inexpensive, and suitable for use in different working conditions. To achieve these and other objects of the present invention, there is provided a grinding control unit installed in a tool bit grinder and adapted to control the feeding of a bit relative to a grinding wheel of a grinding unit of the tool bit grinder, the grinding control unit comprising: a U-shaped support, the U-shaped support comprising a round axle suspended between two upright side walls thereof, and a coupling block turned about and moved axially along the round axle, the coupling block having one end pivoted to the round axle and an opposite end terminating in a receptacle portion; a chuck mounted in the receptacle portion of the coupling block, the chuck having a plurality of pawls disposed at a front end thereof and adapted to hold down a bit for grinding by the grinding wheel of the grinding unit of the tool bit grinder, and a gradation wheel at a rear end thereof; a swinging control mechanism adapted for enabling the chuck to be turned with the coupling block about the round axle, the swinging control mechanism comprising a roller mounted on one upright side wall of the U-shaped support, and a cam wheel mounted on the chuck to guide movement of the chuck relative to the round axle, the cam wheel comprising a radially extended peripheral flange pressed on the roller; a feeder, the feeder comprising a flange formed integral with and axially extended from one side of the cam wheel and aimed at the receptacle portion of the coupling block, the flange of the feeder having two double-beveled protruding portions spaced at 180°, a pulley mounted outside the receptacle portion of the coupling block and disposed in contact with the flange of the feeder.

DETAILED DESCRIPTION OF THE PREFERRED EMBODIMENT

Figure 1:
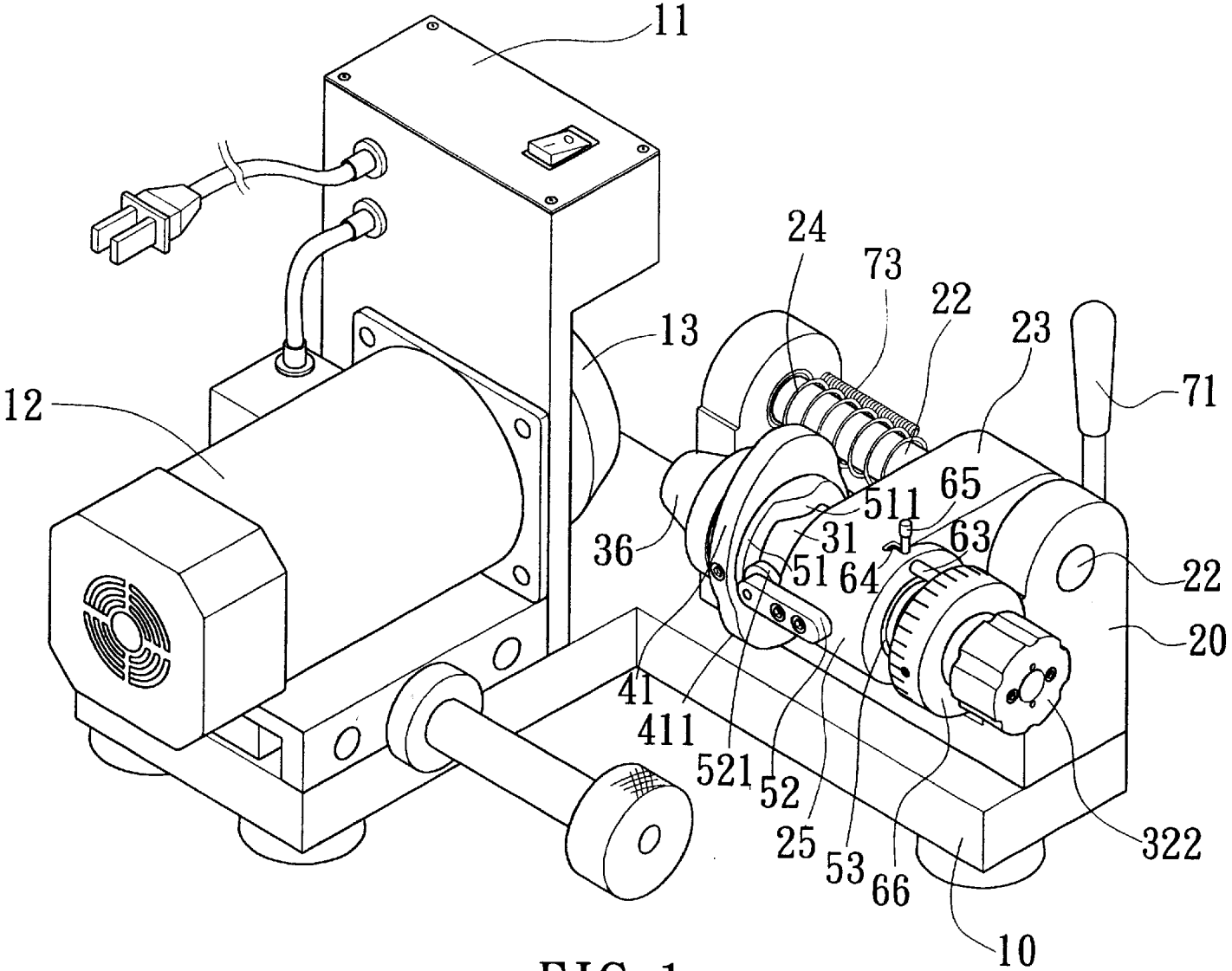
FIG. 1 is a perspective view of a tool bit grinder according to the present invention.
Figure 2:
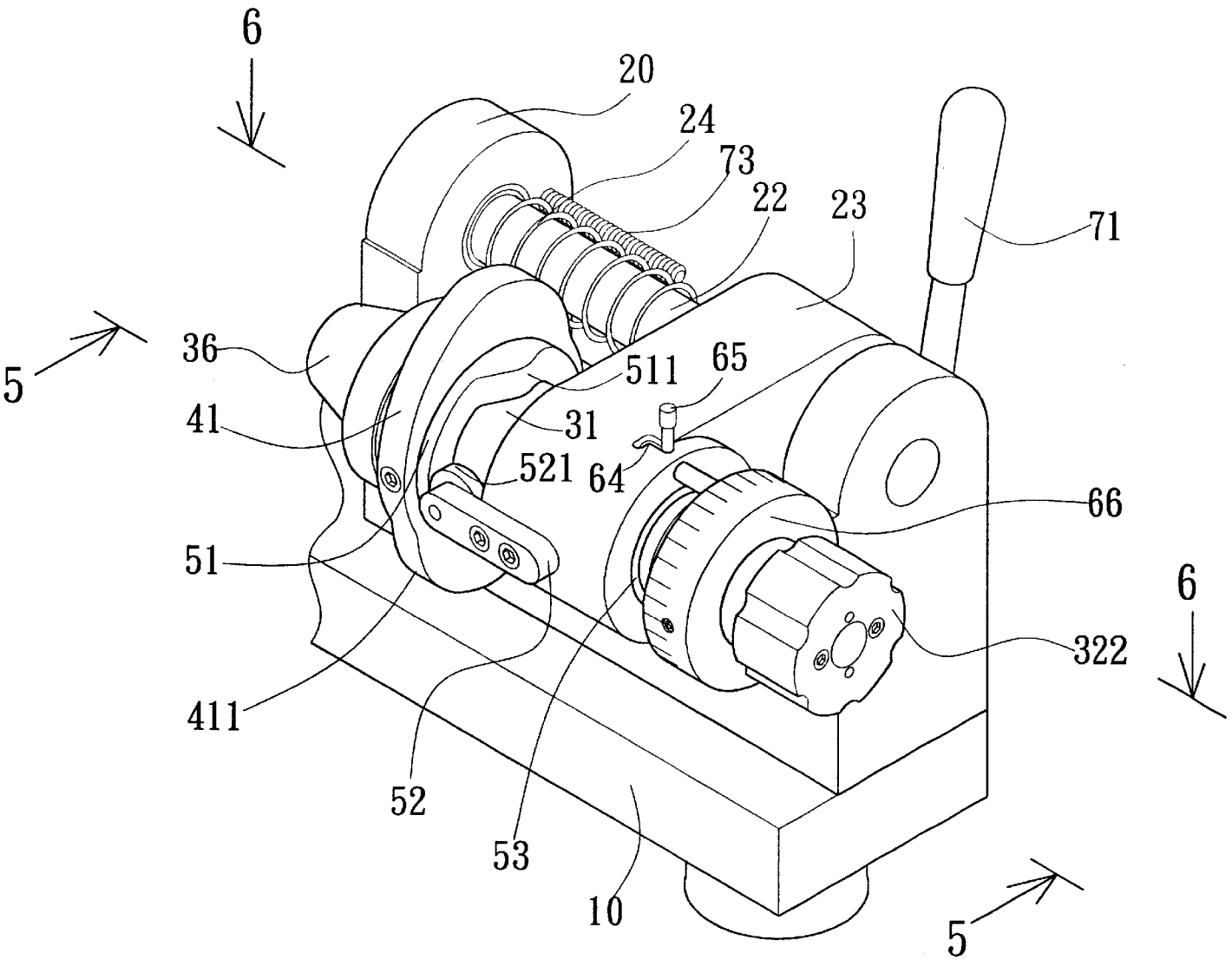
FIG. 2 is an enlarged view of a part of FIG. 1, showing the arrangement of the grinding control unit.

Referring to FIGS. from 1 through 3, a tool bit grinder is shown comprising a grinding unit and a grinding control unit respectively mounted on a machine base 10 thereof. The grinding unit is comprised of an electric distribution box 11, a motor 12 electrically connected to the electric distribution box 11, and a grinding wheel 13 coupled to the motor 12. The grinding control unit is disposed adjacent to the grinding wheel 13, comprising a U-shaped support 20, a chuck 30, a swinging control mechanism, a feeder, a positioning control mechanism, and a horizontal displacement control mechanism.

The U-shaped support 20 comprises a horizontal through hole 21 on each of two upright sidewalls thereof. A round axle 22 is suspended in the U-shaped support 20, having two distal ends respectively inserted in the horizontal through hole 21 on each of the two upright side walls of the U-shaped support 20. A coupling block 23 is turned about the round axle 22. The coupling block 23 has an axle hole 231, which receives the round axle 22. A spring 24 is mounted on the round axle 22 and stopped between one upright sidewall of the U-shaped support 20 and the coupling block 23 to force the coupling block 23 against the other upright sidewall of the U-shaped support 20. The coupling block 23 comprises a vertical groove 232 disposed at one end adjacent to the axle hole 231 (see also FIGS. 9A and 9B), a receptacle portion 25 disposed in parallel to the axle hole 231 and protruded over one side of the U-shaped support 20, a through hole 251 extending axially through the receptacle portion 25 in parallel to the axle hole 231.

Referring to FIGS. from 4 through 6, the chuck 30 is fastened to the receptacle portion 25 of the coupling block 23, and adapted to hold a bit for grinding. The chuck 30 comprises a stepped barrel 31, a driving member 32, a bolt 33, a guide ring 34, a plurality of pawls 35, and a conical shell 36. The stepped barrel 31 is mounted in the receptacle portion 25 of the coupling block 23, comprising a head 311, a tailpiece 313 extended out of the through hole 251 of the receptacle portion 25, and a body 312 connected between the head 311 and the tailpiece 313 and supported inside the receptacle portion 25. The driving member 32 is rotatably mounted in the tailpiece 313 of the barrel 31, having an axially extended screw hole 321. After installation of the driving member 32 in the tailpiece 313 of the barrel 31, a knob 322 is fixedly fastened to one end of the driving member 32 and disposed outside the barrel 31 for turning by hand. The bolt 33 is axially movably mounted in the body 312 of the barrel 31, comprising a head 331, and a threaded shank 333 axially extending from the bottom side of the head 331 and threaded into the screw hole 321 of the driving member 32. The head 331 of the bolt 33 comprises a plurality of locating grooves 332 radially disposed the topside thereof. The guide ring 34 is mounted in the head 311 of the barrel 31, comprising a plurality of teeth 341 equiangularly spaced from one another at one side by gaps 342 and sloping forwardly inwards. The pawls 35 are respectively mounted in the gaps 342, each comprising a locating tooth 351 disposed at one end and engaged into one locating groove 332 at the head 331 of the bolt 33, a beveled tip 352 disposed at an opposite end, and a sloping guide track 353 extended along one side of the beveled tip 352 and coupled to one tooth 341 of the guide ring 34 to guide movement of the respective pawl 35. The conical shell 36 is fastened to the head 311 of the barrel 31 to hold the guide ring 34 in the head 311 of the barrel 31, having a center opening 361 adapted to receive the bit 37 to be ground and the beveled tip 352 of each pawl 35.

Figure 3:
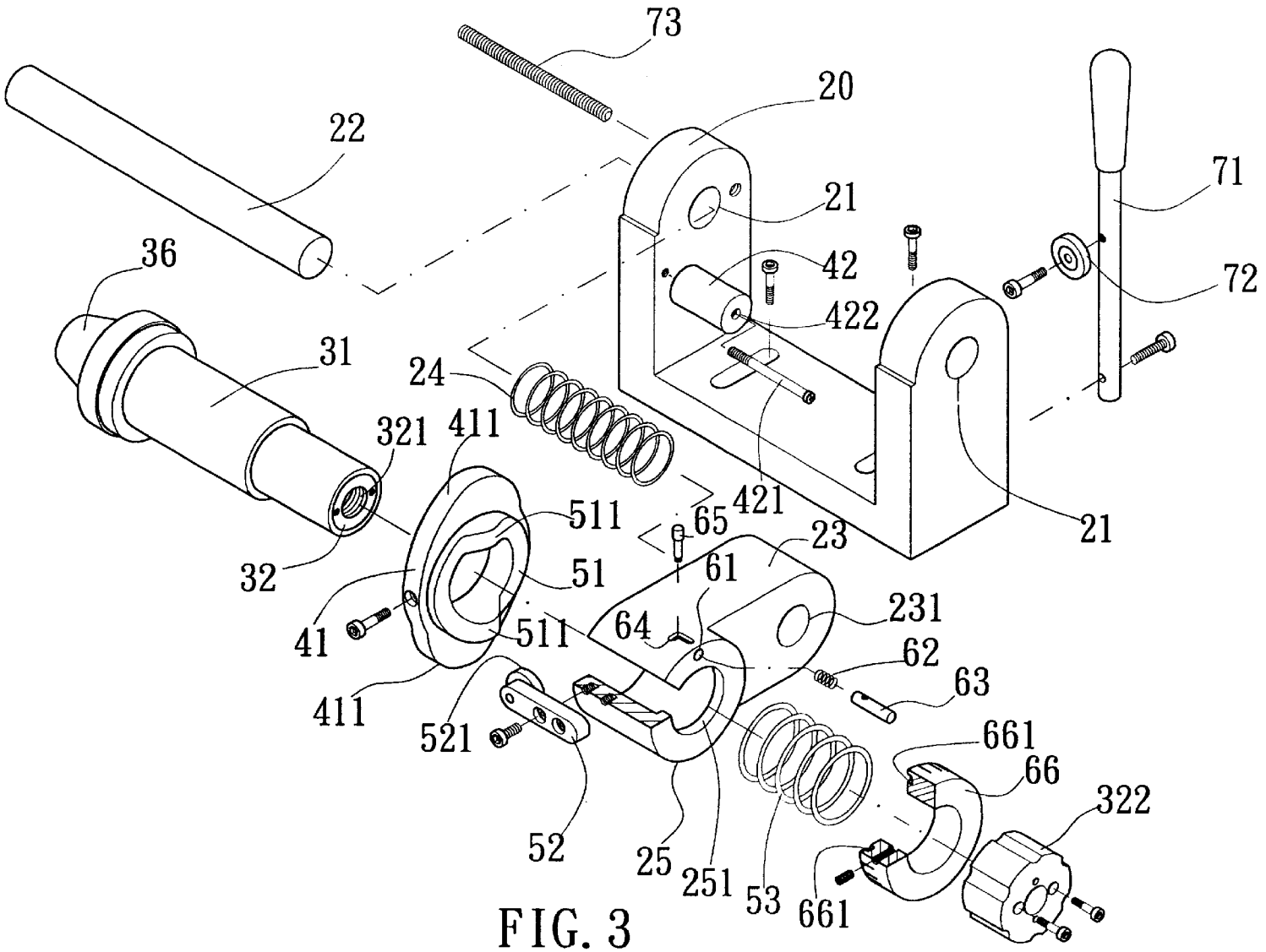
FIG. 3 is an exploded view of the grinding control unit shown in FIG. 2.
Figure 4:
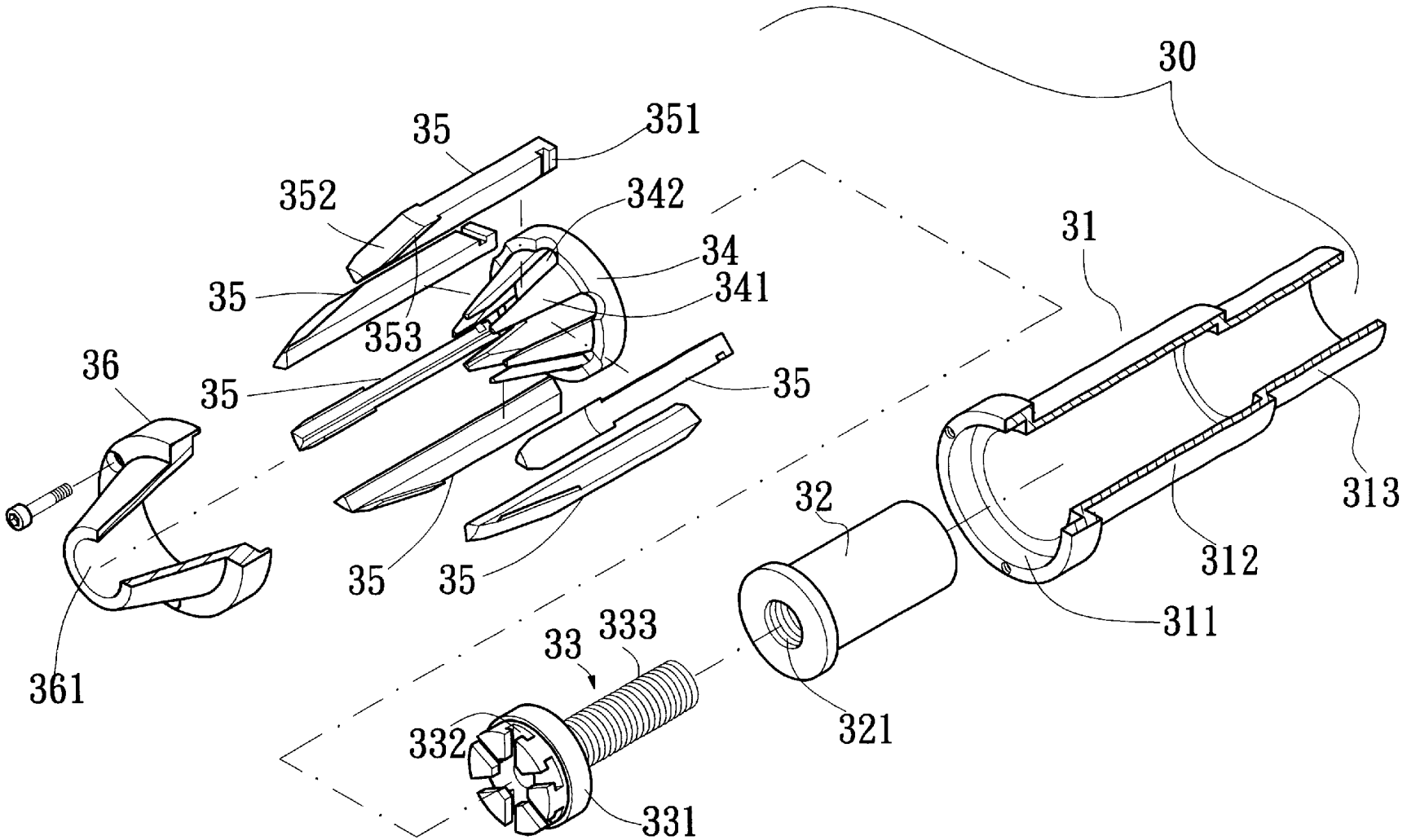
FIG. 4 is an exploded view of the shuck for the grinding control unit of the tool bit grinder according to the present invention.
Figure 7A:
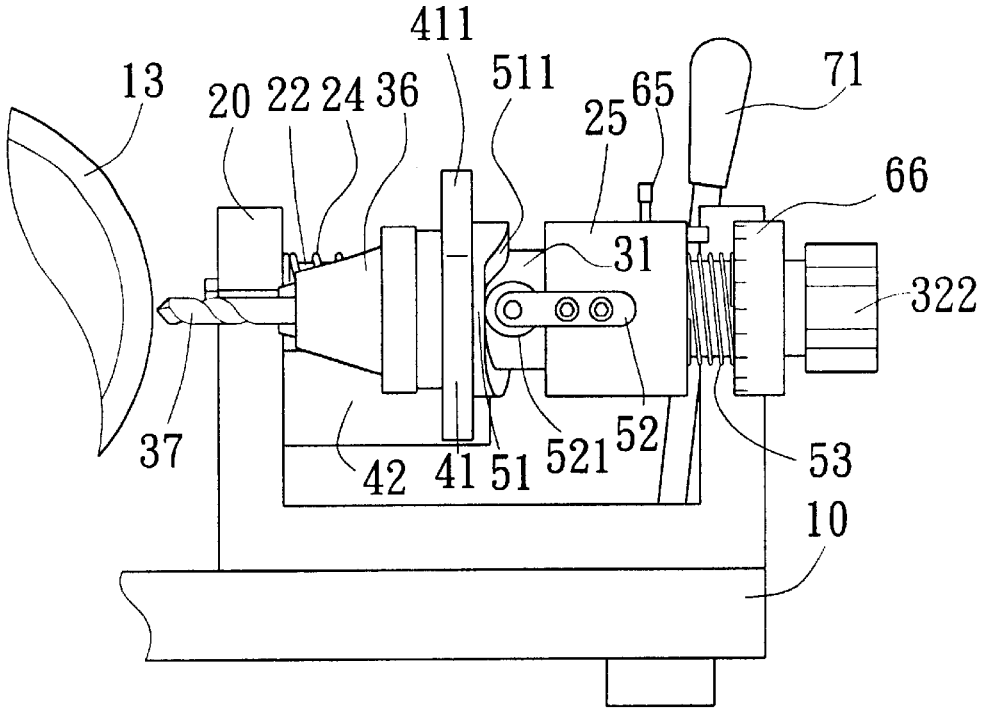
FIG. 7A is a side view of the grinding control unit for the tool bit grinder according to the present invention.
Figure 7B:
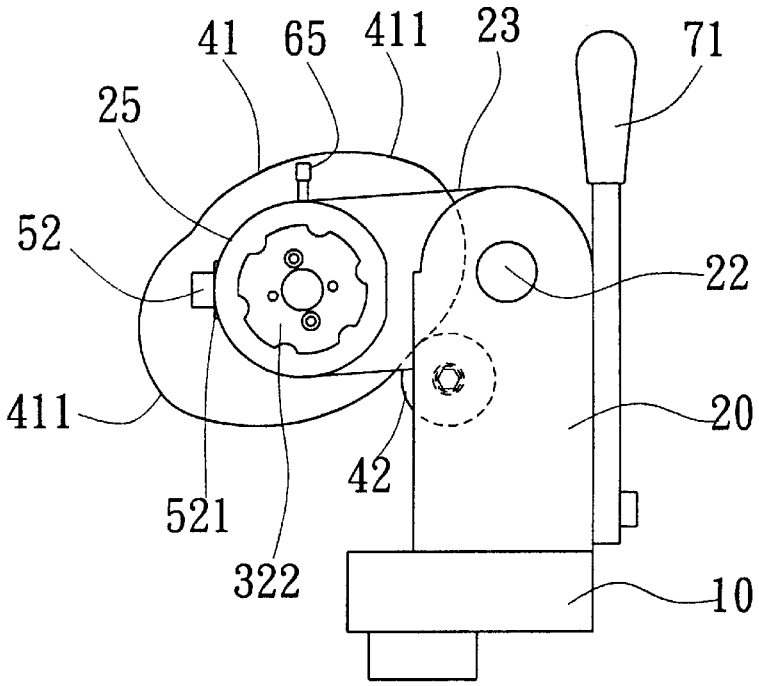
FIG. 7B is a right side view of FIG. 7A.

Referring to FIGS. 7B and FIG. 3 again, the aforesaid swinging control mechanism comprises a cam wheel 41 mounted on the body 312 of the barrel 31, the can wheel 41 having a radially extended peripheral flange 411, a fixed axle 421 perpendicularly inwardly extended from one upright side wall of the U-shaped support 20, a roller 42 turned about the fixed axle 422 and disposed in contact with the periphery of the cam wheel 41.

Referring to FIG. 7A and FIG. 3 again, the aforesaid feeder comprises a flange 51 formed integral with and axially extended from one side of the cam wheel 41 and aimed at the receptacle portion 25 of the coupling block 23, the flange 51 having two double-beveled protruding portions 511 spaced at 180°, a suspension arm 52 having one end fixedly axially fastened to the outside wall of the receptacle portion 25 of the coupling block 23 and an opposite end suspended outside the receptacle portion 25 of the coupling block 23 an mounted with a pulley 521, and a spring 53 mounted on the tailpiece 313 of the barrel 31 and stopped between the receptacle portion 25 of the coupling, block 23 and the aforesaid positioning control mechanism to force the pulley 521 into contact with the flange 51 at the cam wheel 41.

Figure 5:
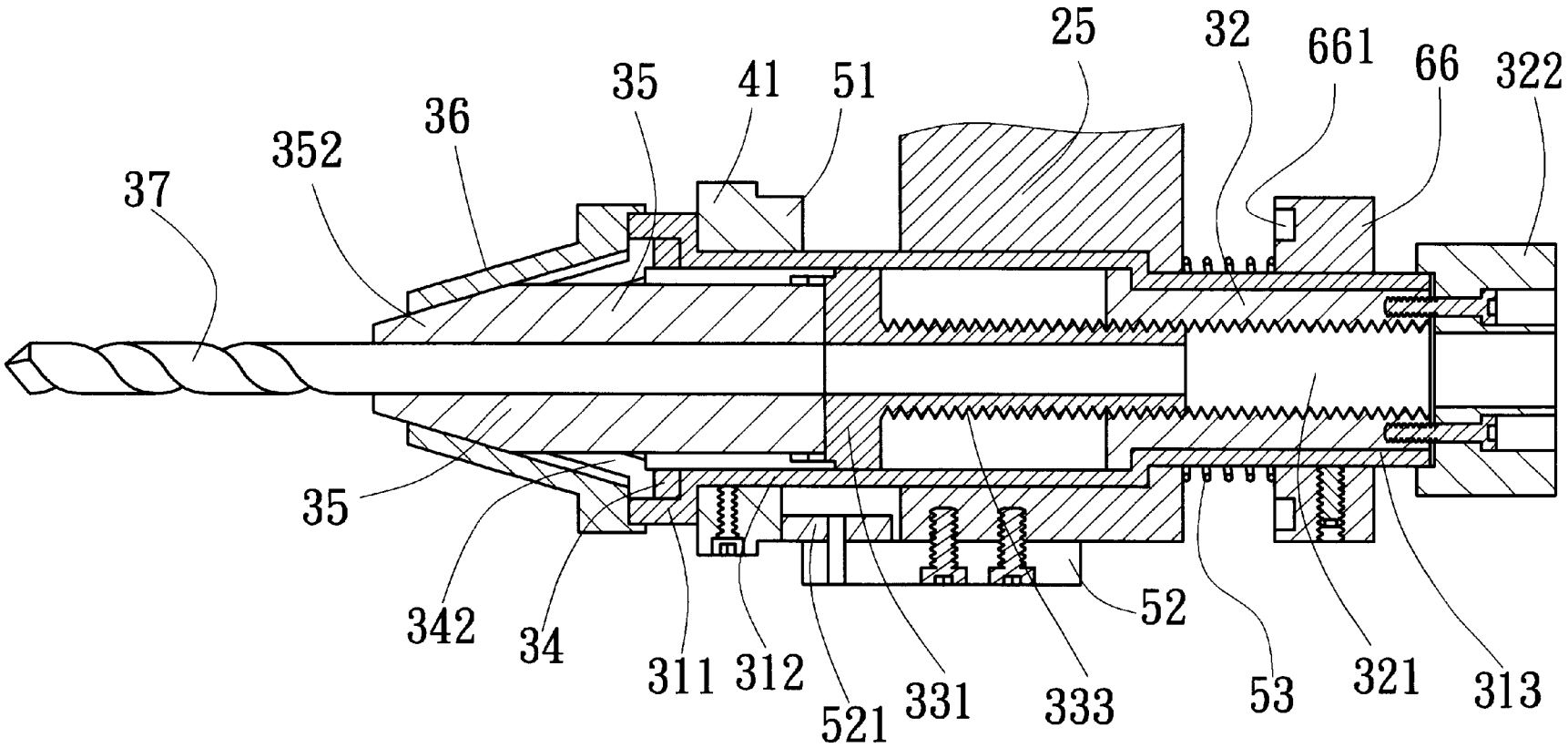
FIG. 5 is a sectional view taken along line 5—5 of FIG. 2.
Figure 6:
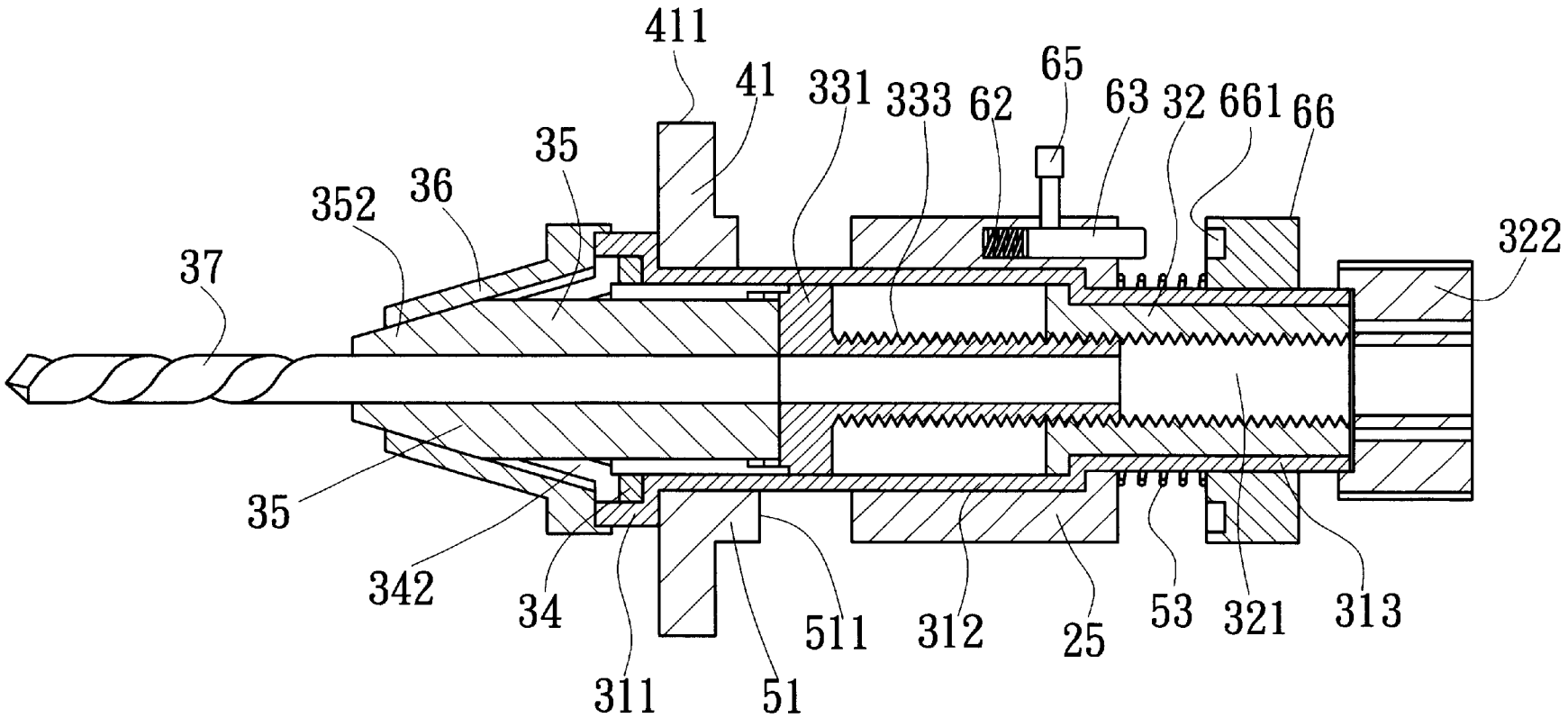
FIG. 6 is a sectional view taken along line 6—6 of FIG. 2.

Referring to FIGS. 5 and 6 and FIG. 3 again, the aforesaid positioning control mechanism comprises an axially extended blind hole 61 formed on one side, namely, the rear side of the receptacle portion 25 of the coupling block 23, a spring 62 mounted in the blind hole 61, a lock pin 63 supported on the spring 62 in the blind hole 61, a L-shaped slot 64 formed on the receptacle portion 25 of the coupling block 23 at a top side in communication with the blind hole 61, a control rod 65 fixedly fastened to the lock pin 63 and moved along the L-shaped slot 64 between a first position where the spring 62 is released and the lock pin 63 is pushed forwards to the locking position, and a second position where the lock pin 63 is moved backwards from the locking position to the unlocking position and the spring 62 is compressed by the lock pin 63, and a graduation ring 66 press-fitted onto the tailpiece 313 of the barrel 31. The graduation ring 66 has positioning notches 661 equiangularly spaced at the front side corresponding to the graduations thereof and adapted to receive the lock pin 63.

Figure 9C:
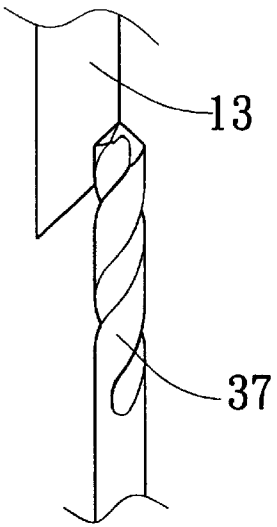
FIG. 9C is an enlarged view of a part of FIG. 9B, showing the bit fed to the grinding wheel.
Figure 9A:
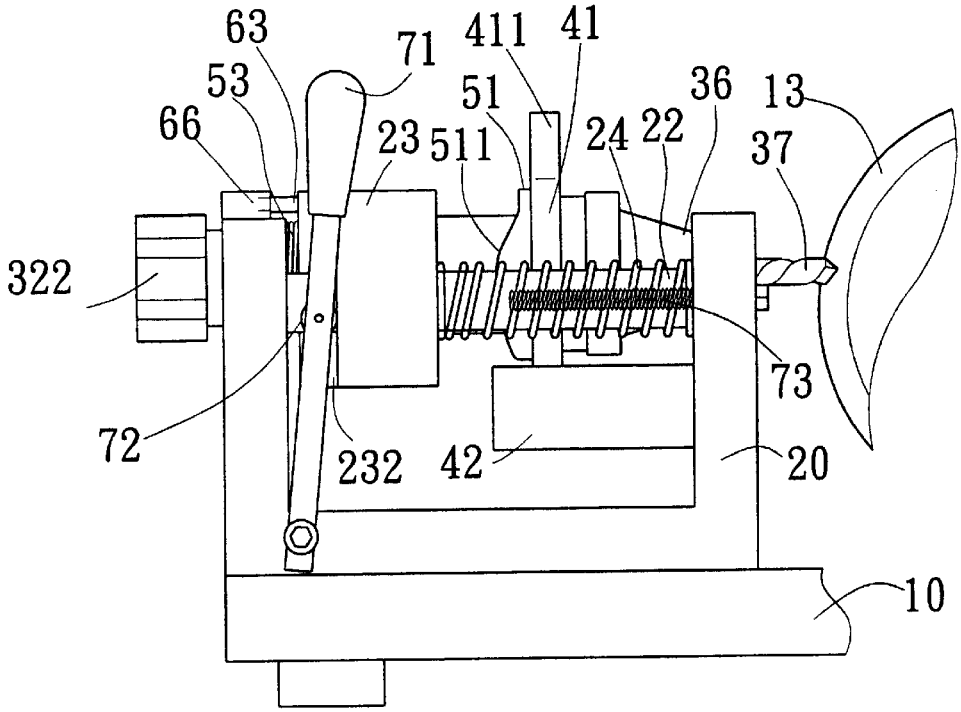
FIG. 9A is another side view of the grinding control unit, showing the bit fed to the grinding wheel according to the present invention.

Referring to FIG. 9A and FIG. 3 again, the aforesaid horizontal displacement control mechanism comprises a handle 71 having a bottom end pivoted to the U-shaped support 20, a guide wheel 72 mounted on a middle part of the handle 71 and inserted into the vertical groove 232 of the coupling block 23, and a stop screw rod 73 perpendicularly fastened to one upright side wall of the U-shaped support 20 adjacent to the round axle 22 to limit the moving distance of the coupling block 23 along the round axle 22.

The operation of the present invention is outlined hereinafter. The knob 322 is rotated with the hand chuck 30 in one direction. Rotating the knob 322 in one direction causes the bolt 33 to move axially forwards (because the threaded shank 333 of the bolt 33 is threaded into the screw hole 321 of the driving member 32, which is rotated with the knob 322 in the barrel 31). When moving the bolt 33 forwards, the pawls 35 are forced forwards along the tapered inside wall of the conical shell 36 by the bolt 33 to hold down the bit 37. On the contrary, when rotating the knob 322 in the reversed direction, the bolt 33 is moved axially backwards. Because the locating tooth 351 of each pawl 35 is engaged into one locating grooves 332 at the head 331 of the bolt 33, the pawls 35 are moved backwards with the bolt 33 when rotating the knob 322 in the reversed direction. By means of the relative action between the sloping guide track 353 of each pawl 35 and the teeth 341 of the guide ring 34, the pawls 35 are smoothly obliquely moved back and forth along the tapered inside wall of the conical shell 36.

Figure 7C:
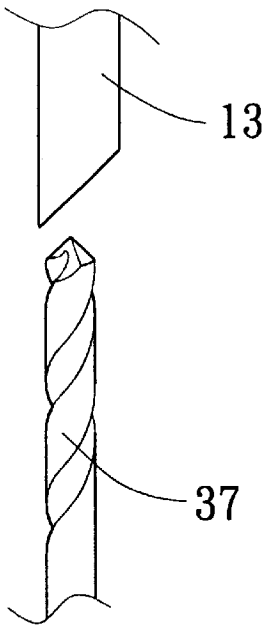
FIG. 7C is an enlarged view of a part of FIG. 7A, showing the bit spaced from the grinding wheel according to the present invention.

After the bit 37 has been positively held down, the feeder, the swinging control mechanism, and the horizontal displacement control mechanism are operated to control the grinding position of the bit 37. When at the stand-by position, the roller 42 and the pulley 521 are pressed at the radially extended peripheral flange 411 of the cam wheel 41 and the lowest point at one protruding portion 511 of the flange 51, the bit 37 is spaced from the grinding wheel 13 at a distance (see FIGS. 7A, 7B and 7C), and the corresponding graduation at the graduation ring 66 indicates the zero reading.

When rotating the graduation ring 66, the barrel 31 and the cam wheel 41 are rotated with the graduation ring 66, and the bit 37 is rotated synchronously, and at the same time the spring force of the spring 53 forces the pulley 521 against the flange 51. When rotated through 180°, one beveled side edge of one protruding portion 511 of the flange 51 is moved against the pulley 521, thereby causing the barrel 31, the chuck 30 and the bit 37 are moved axially toward the grinding wheel 13.

Figure 8C:
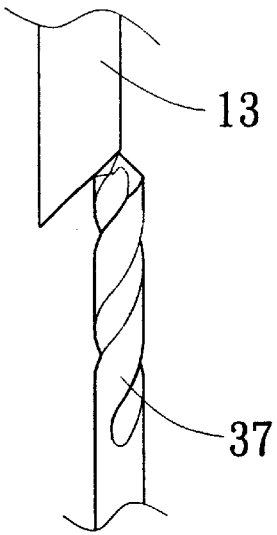
FIG. 8C is an enlarged view of a part of FIG. 8A, showing the bit fed to the grinding wheel.
Figure 8A:
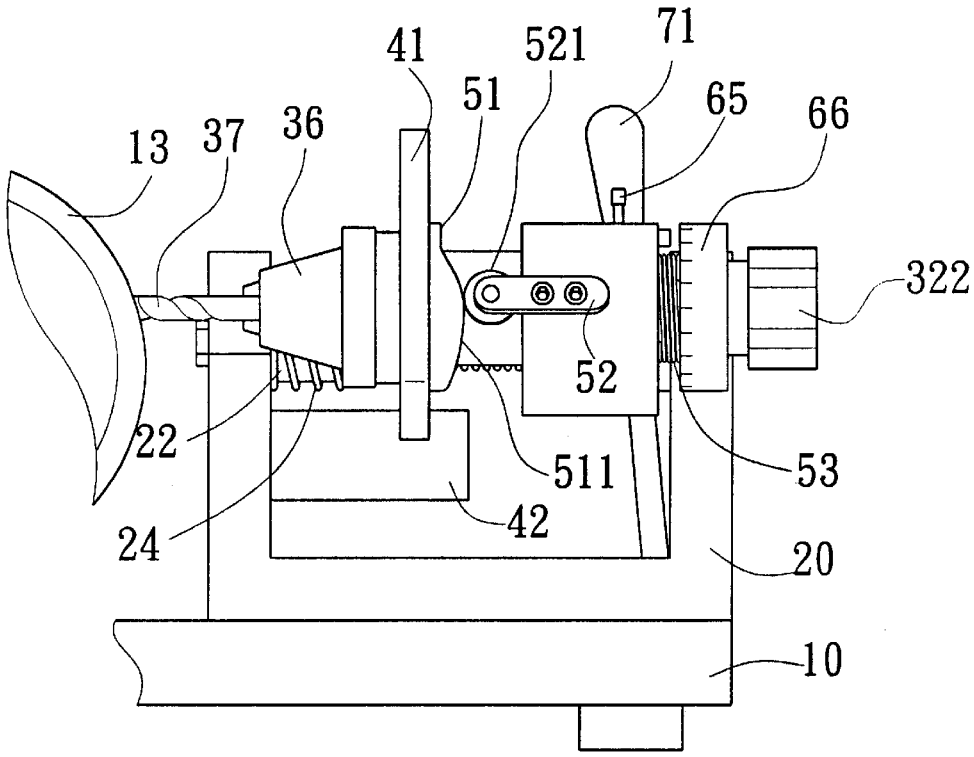
FIG. 8A is similar to FIG. 7A but showing the bit fed to the grinding wheel 13.
Figure 8B:
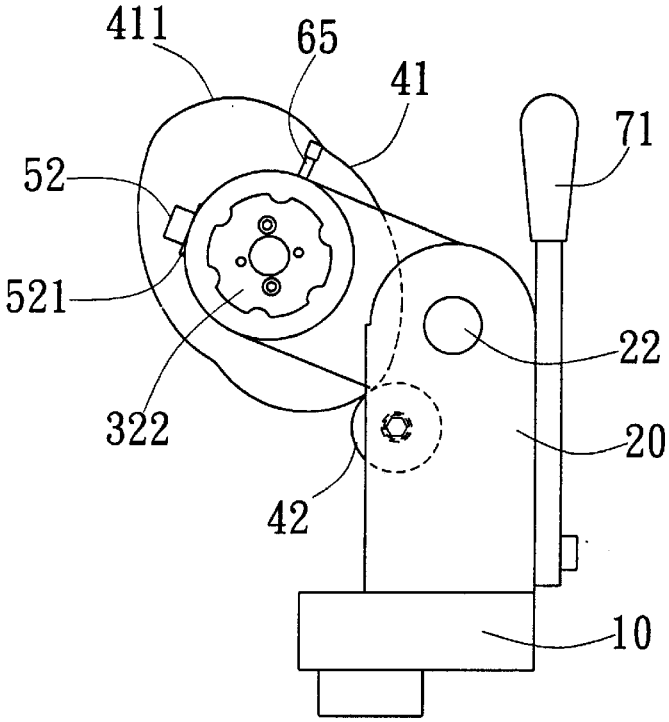
FIG. 8B is a right side view of FIG. 8A.

When feeding the bit 37 toward the grinding wheel 13 (see FIGS. 8A, 8B and 8C), the radially extended peripheral flange 411 of the cam wheel 41 is pressed against the roller 42, thereby causing the coupling block 23 to be turned about the round axle 22 to move the bit 37 circularly against the grinding wheel 13, and therefore the grinding wheel 13 grinds the lip 371 at one side of the bit 37. After the barrel 31 has been rotated through 180°, the highest point (the major axis) of the radially extended peripheral flange 411 of the cam wheel 41 and the highest points of one protruding portion 5111 of the flange 51 are respectively stopped at the roller 42 and the pulley 521, at this time the grinding operation of the lip 371 at one side of the bit 37 has been finished. When continuing the aforesaid action, the barrel 31 is continuously rotated in the same direction, and the radially extended peripheral flange 411 of the cam wheel 41 and the flange 51 are respectively moved relative to the roller 42 and the pulley 521 from the topmost point toward the lowest point, thereby causing the bit 37 to be rotated and moved away from the grinding wheel 13 to complete the grinding operation of the lip 371 at the other side of the bit 37.

Figure 10:
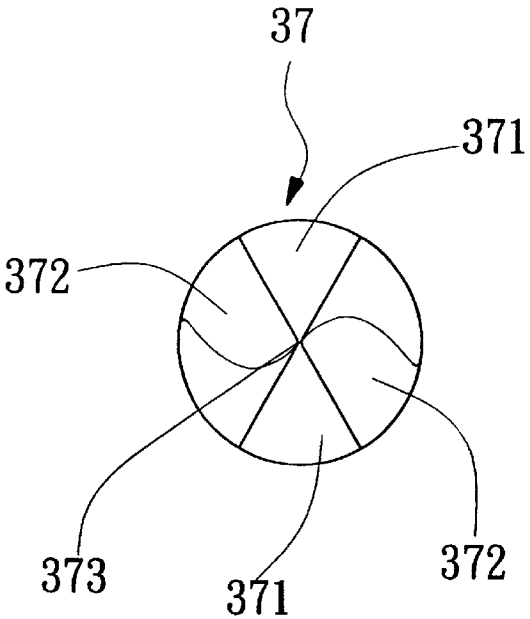
FIG. 10 is a front-end view in plain in an enlarged scale of a bit according to the present invention.
Figure 9B:
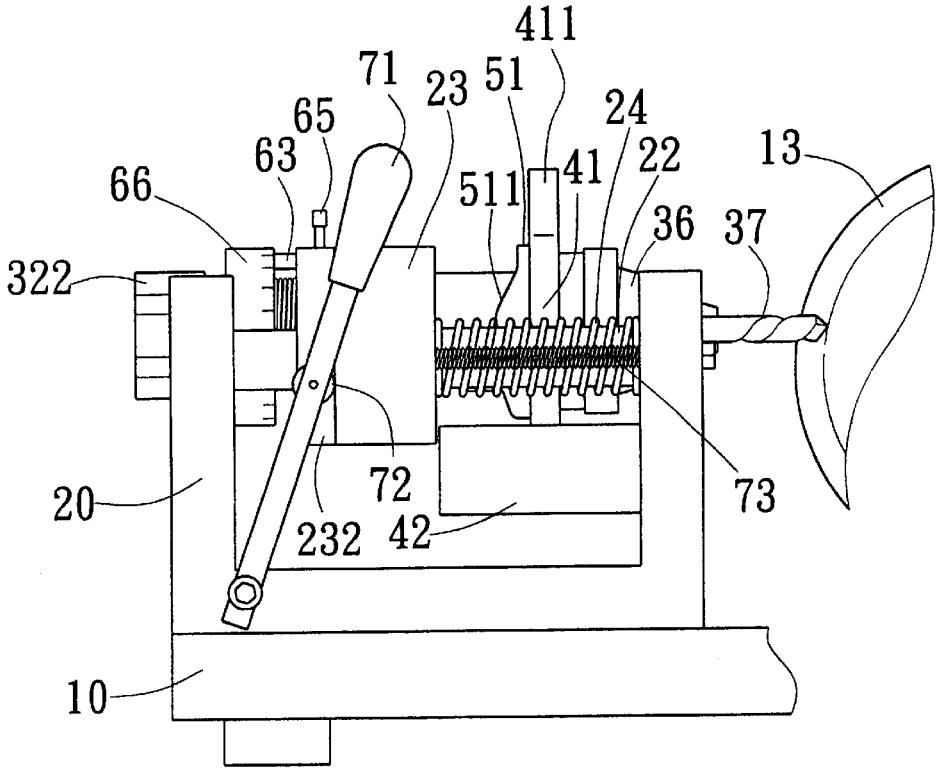
FIG. 9B is similar to FIG. 9A but showing the handle turned toward the grinding wheel, the bit fed forwards further.

Referring to FIGS. 9A, 9B and 9C, when rotating the barrel 31 to the angle where the graduation of the graduation ring 66 indicates 90°, the control rod 65 is moved to the first position to release the spring 62 and to let the lock pin 63 be forced into one positioning notch 661 of the graduation ring 66 to stop the barrel 31 from rotary motion. After the barrel 31 has been locked and prohibited from rotary motion, the handle 71 is turned toward the grinding wheel 13 to move the guide wheel 72 along the vertical groove 232 of the coupling block 23, causing the coupling block 23 and the chuck 30 to be moved along the round axle 22 toward the grinding wheel 13 to compress the spring 24, and therefore the bit 37 is fed forward further, enabling the grinding wheel 13 to grind the spur 372 of the bit 37. When releasing the handle 71, the spring 24 immediately pushes the coupling block 23 back to its former position. Thereafter, the barrel 31 is rotated to 270° position, and then the aforesaid grinding operation is repeated, enabling the center standing point 373 to be well ground to the desired sharpen status (See FIG. 10).

As indicated above, after the bit 37 has been held down in the chuck 30, the user needs only to rotate the graduation ring 66 when feeding the bit 37, and the spur 372 of the bit 37 will be well ground. Further, by means of controlling the positioning control mechanism and the horizontal displacement control mechanism, the center standing point 373 is sharpened.

While only one embodiment of the present invention has been shown and described, it will be understood that various modifications and changes could be made thereunto without departing from the spirit and scope of the invention disclosed.

What the invention claimed is:

1. A grinding control unit installed in a tool bit grinder and adapted to control the feeding of a bit relative to a grinding wheel of a grinding unit of the tool bit grinder, the grinding control unit comprising:

a U-shaped support, said U-shaped support comprising a round axle suspended between two upright side walls thereof, and a coupling block turned about and moved axially along said round axle, said coupling block having one end pivoted to said round axle and an opposite end terminating in a receptacle portion;

a chuck mounted in said receptacle portion of said coupling block, said chuck having a plurality of pawls disposed at a front end thereof and adapted to hold down a bit for grinding by the grinding wheel of the grinding unit of the tool bit grinder, and a gradation wheel at a rear end thereof;

a swinging control mechanism adapted for enabling said chuck to be turned with said coupling block about said round axle, said swinging control mechanism comprising a roller mounted on one upright side wall of said U-shaped support, and a cam wheel mounted on said chuck to guide movement of said chuck relative to said round axle, said cam wheel comprising a radially extended peripheral flange pressed on said roller;

a feeder, said feeder comprising a flange formed integral with and axially extended from one side of said cam wheel and aimed at the receptacle portion of said coupling block, the flange of said feeder having two double-beveled protruding portions spaced at 180°, a pulley mounted outside the receptacle portion of said coupling block and disposed in contact with the flange of said feeder.

2. The grinding control unit of claim 1 further comprising a positioning control mechanism adapted to lock said coupling block and said chuck in position, and a horizontal displacement control mechanism adapted to move said coupling block and said chuck axially along said round axle, said positioning control mechanism comprising an axially extended blind hole formed on a rear side of the receptacle portion of said coupling block, a spring mounted in said blind hole, a lock pin supported on the spring in said blind hole, a L-shaped slot formed on the receptacle portion of said coupling block at a top side in communication with said blind hole, a control rod fixedly fastened to said lock pin and moved along said L-shaped slot between a first position where the spring in said blind hole is released and said lock pin is pushed forwards into engagement with equiangularly spaced locating notches of said graduation ring to lock said chuck, said swinging control mechanism and said feeder, and a second position where said lock pin is moved backwards and disengaged from said graduation ring to unlock said chick, said swinging control mechanism and said feeder, said horizontal displacement control mechanism comprising a handle having a bottom end pivoted to said U-shaped support, a vertical groove provided at said coupling block, and a guide wheel mounted on a middle part of said handle and inserted into the vertical groove of said coupling block for enabling said coupling block to be moved axially along said round axle toward the grinding wheel of the tool bit grinder by said guide wheel when turning said handle in one direction.

3. The grinding control unit of claim 2 wherein said horizontal displacement control mechanism further comprising a stop screw rod perpendicularly fastened to one upright side wall of said U-shaped support adjacent to said round axle and adapted to limit the moving distance of said coupling block along said round axle.

4. The grinding control unit of claim 1 wherein said chuck comprises a stepped barrel fastened with a middle part thereof to the inside of the receptacle portion of said coupling block, a driving member mounted in a rear end of said stepped barrel, said driving member having an axially extended screw hole, a knob fixedly fastened to a rear end of said driving member and disposed outside said barrel for turning by hand to rotate said driving member in said barrel, a bolt axially movably mounted in said barrel and threaded into the axially extended screw hole of said driving member, said bolt comprising a head and a plurality of locating grooves radially disposed on said head, a fixed guide ring mounted in a front end of said barrel, said guide ring comprising a plurality of teeth equiangularly spaced from one another at one side by gaps and sloping forwardly inwards and adapted to guide movement of said pawls, said pawls each comprising a locating tooth disposed at one end and engaged into one locating groove at the head of said bolt, a beveled tip disposed at an opposite end and adapted to hold down the bit inserted into said chuck for grinding, and a sloping guide track extended along one side of said beveled tip and coupled to one tooth of said guide ring to guide movement of the respective pawl, and a conical shell fastened to said barrel to hold said guide ring in barrel in position, said conical shell having a center opening adapted to receive the bit to be ground and the beveled tip of each of said pawls.

5. The grinding control unit of claim 1 further comprising a spring mounted on said round axle and stopped between one upright sidewall of said U-shaped support and said coupling block.

6. The grinding control unit of claim 1 wherein said feeder further comprises a spring mounted on said chuck and stopped between the receptacle portion of said coupling block and said graduation ring.

* * * * *